US012440047B2

(12) United States Patent
Prusinowski et al.

(10) Patent No.: US 12,440,047 B2
(45) Date of Patent: Oct. 14, 2025

(54) METERED FOOD DISPENSER WITH SINGLE MOTOR ACTUATED WEIGHING AND DISPENSING MECHANISMS

(71) Applicant: Franke Technology and Trademark Ltd, Hergiswil (CH)

(72) Inventors: Mateusz Prusinowski, Olsztyn (PL); Ireneusz Czapp, Reda (PL); Khalil Chmayssani, Nolensville, TN (US); Marek Ormanin, Suchy Dwór (PL)

(73) Assignee: Franke Technology and Trademark Ltd, Hergiswil (CH)

( * ) Notice: Subject to any disclaimer, the term of this patent is extended or adjusted under 35 U.S.C. 154(b) by 228 days.

(21) Appl. No.: 18/496,155

(22) Filed: Oct. 27, 2023

(65) Prior Publication Data

US 2024/0138596 A1 May 2, 2024

Related U.S. Application Data

(60) Provisional application No. 63/420,781, filed on Oct. 31, 2022.

(51) Int. Cl.
*A47F 3/02* (2006.01)

(52) U.S. Cl.
CPC ..... *A47F 3/02* (2013.01)

(58) Field of Classification Search
CPC . A47F 3/02; G07F 11/24; G07F 11/52; G07F 17/0064; G07F 11/44; B65G 65/4881; B65G 69/00; G01G 13/003; G01G 13/18; G01G 13/247
See application file for complete search history.

(56) References Cited

U.S. PATENT DOCUMENTS 6,131,622 A * 10/2000 Fritze ..... G07F 11/44 141/192
6,305,573 B1 * 10/2001 Fritze ..... B65B 37/08 222/77
7,802,593 B2 * 9/2010 Koerner ..... G07F 17/0071 141/82
8,251,108 B2 * 8/2012 Koerner ..... G07F 17/0071 141/82

(Continued)

FOREIGN PATENT DOCUMENTS

CN 213239131 U 5/2021
CN 213239132 U 5/2021

*Primary Examiner* — Bob Zadeh
(74) *Attorney, Agent, or Firm* — Volpe Koenig

(57) ABSTRACT

A product dispenser having a storage hopper, a rotatable drum with paddles on a periphery thereof located at a bottom of the storage hopper, and a drive motor connected to the rotatable drum. Rotation of the drum causes product, preferably frozen food product, to dispense from the open bottom of the hopper to a weighing/dispensing assembly which includes dump doors on which product to be dispensed is accumulated. The dump doors are connected to a support assembly that is movable into and out of contact with a load cell. A single weighing/dispensing motor drives a gearbox that includes an actuator shaft moves the support assembly into and out of contact with the load cell and also activates the dump doors to dispense accumulated product when a desired amount accumulates. A controller is provided and is configured to actuate the drive motor and control a dispensing cycle.

10 Claims, 8 Drawing Sheets

(56) References Cited

U.S. PATENT DOCUMENTS

| | | | | |
|---|---|---|---|---|
| 11,482,066 | B2 * | 10/2022 | Allegra | G07F 11/44 |
| 2001/0040170 | A1 * | 11/2001 | Fritze | B65B 37/08 222/77 |
| 2006/0113324 | A1 * | 6/2006 | Rudesill | A47F 1/035 222/132 |
| 2008/0230558 | A1 * | 9/2008 | Koerner | G07F 17/0071 222/54 |
| 2011/0101022 | A1 * | 5/2011 | Koerner | G07F 17/0071 222/1 |
| 2024/0138596 | A1 * | 5/2024 | Prusinowski | A47F 3/02 |

* cited by examiner

METERED FOOD DISPENSER WITH SINGLE MOTOR ACTUATED WEIGHING AND DISPENSING MECHANISMS

CROSS-REFERENCE TO RELATED APPLICATIONS

This application claims the benefit of U.S. Provisional Application No. 63/420,781, filed Oct. 31, 2022, which is incorporated herein by reference as if fully set forth.

TECHNICAL FIELD

The present invention relates to the field of metered food dispensers that dispense a metered quantity of food product from a hopper. More particularly, the invention relates to a dispenser for frozen food, which can be, for example, French fries, that are dispensed from a bulk storage hopper in metered batch sizes to a fry basket.

BACKGROUND

Applicant has developed and markets metered food dispensers, particularly for frozen foods such as French fries or chicken nuggets, that dispense bulk food product from a storage hopper into a receptacle, such as a fry basket. The frozen food is dispensed in specific metered quantities as the amount of the frozen food that is dispensed at one time can affect quality of the finished (cooked) food product, for example, based on the temperature change imparted by the food product to the cooking oil as well as the necessary fry time in the cooking oil. Currently, the frozen food product is removed from a bottom of the storage hopper via a rotating drum having paddles or fins on a periphery thereof by rotating the drum so that the food product that is released/displaced by the paddles fall onto a weighing/dispensing assembly, and when the appropriate weight of food product is detected by the weighing/dispensing assembly, the rotation of the drum stops, and the accumulated food product that was dispensed is delivered to the receptacle, for example, the fry basket.

In the known equipment, the weighing/dispensing assembly includes or is connected to one or more dump doors on which the dispensed food product accumulates. A first motor operates these dump doors to open when the appropriate amount of food product is accumulated in order to dispense a metered amount or batch of food product. Additionally, the dump doors are supported via a support assembly that is movable into and out of contact with a load cell that forms part of the weighing/dispensing assembly in order to determine the weight of the product that has been dispensed onto the dump doors. Here, a second motor is used to move the support assembly relative to the load cell so that the weight of the support assembly and the dump doors is not constantly on the load cell when the dispenser is not in active use.

Although the known arrangement has been very successful in operation, it would be desirable to maintain or improve the function and reliability of the system while reducing cost.

SUMMARY

The present disclosure is directed to a product dispenser, preferably for frozen food product, having a storage hopper, a rotatable drum having paddles on a periphery thereof located at a bottom of the storage hopper, and a drive motor connected to the rotatable drum. Rotation of the drum causes the paddles to engage with and move product from the open bottom of the hopper to a position in the drum housing where the product can then fall through the open bottom of the drum housing. A weighing/dispensing assembly is located beneath the rotatable drum and includes a load cell and further includes or is connected to one or more dump doors on which product to be dispensed is adapted to accumulate. The one or more dump doors are connected to a support assembly that is movable into and out of contact with the load cell. A single weighing/dispensing motor drives a gearbox that includes an actuator shaft such that upon rotation of the actuator shaft in a first direction, the support assembly is raised out of contact with the load cell and the one or more dump doors are opened such that accumulated product is dispensed. Upon rotation of the actuator shaft in a second, opposite direction, the one or more dump doors are closed, and upon further rotation, the support assembly moves into contact with the load cell. The dispenser is then in a position to receive a next batch of food product from the hopper.

A controller is provided and is configured to actuate the drive motor to rotate the rotatable drum at a start of a dispensing cycle, and to receive a signal from the load cell and determine a weight of the product accumulating on the dump doors. The controller is further configured to deactivate the drive motor upon a target weight being detected, and to activate the single weighing/dispensing motor to drive the actuator shaft in the first direction to raise the support assembly out of contact with the load cell and open the one or more dump doors such that accumulated product is dispensed. The controller is then configured to activate the single weighing/dispensing motor to rotate the actuator shaft in the second direction to close the one or more dump doors. The controller is further configured to activate the single weighing/dispensing motor to further rotate the actuator shaft in the second direction to move the support assembly back into contact with the load cell upon a new dispensing cycle being initiated.

In another aspect, the product dispenser includes an actuating arm connected to the actuator shaft, and the one or more dump doors are connected to one or more rotatable support shafts that are supported by the support assembly, and the actuating arm contacts a lever connected to at least one of the one or more rotatable support shafts to open the one or more dump doors as the single weighing/dispensing motor drives the actuator shaft in the first direction.

In a preferred arrangement, the one or more dump doors include first and second ones of the dump doors that are connected to respective first and second ones of the rotatable support shafts, and a linkage arm extends between the lever connected to the first rotatable shaft and a second lever connected to the second rotatable shaft, such that as the actuating arm contacts the lever connected to the first rotatable support shaft to open the first dump door, the linkage arm acts on the second lever to open the second dump door.

In one preferred aspect of the product dispenser, the support assembly is slidably mounted on guides affixed to a mounting plate, and the mounting plate includes elongated openings through which the one or more rotatable support shafts extend. The elongated openings allow enough space for upward and downward travel of the rotatable support shafts as the support assembly is moved up and down as part of the dispensing and weighing cycle in order to discharge a specific amount of food product.

In a preferred embodiment, a lifting cam is connected to the actuator shaft, and the lifting cam is configured to raise the support assembly as the single weighing/dispensing motor drives the actuator shaft in the first direction. This removes the combined weight of the support assembly, rotatable support shaft(s), dump door(s), and product that is accumulated on the dump door(s) from the load cell prior to opening the dump doors to discharge the product accumulated thereon.

Further, the lifting cam is configured to lower the support assembly as the single weighing/dispensing motor drives the actuator shaft in the second direction. This is done at the start of a next dispensing cycle so that the load cell is not under load when the product dispenser is not in use.

Preferably, the lifting cam is configured to come out of contact with the support assembly as the support assembly reaches a weighing position in contact with the load cell.

In another aspect, the product dispenser includes a position indicator connected to the actuator shaft and a sensor that detects a position of the position indicator and signals the controller. This is used so that the controller can detect a position of the actuator shaft before or during each dispensing cycle. The position sensor is a break-beam sensor, and the position indicator is a "flag" connected to the actuator shaft.

In a preferred application, the product dispenser is for dispensing frozen food product, such as French fires of chicken nuggets into a fry basket that is arranged below the dump doors. A refrigerated housing surrounds the hopper and the rotatable drum. Placement of the fry basket below the dispenser activates a dispensing cycle by the fry basket pressing a switch or otherwise being detected, which signals the controller to begin a dispensing cycle. The dispensing cycle can include:

- Activating the single weighing/dispensing motor by the controller to rotate the actuator shaft in the second direction to move the support assembly into contact with the load cell;
- Actuating the drive motor to rotate the rotatable drum in order to deliver food product from the hopper to the one or more dump doors on the weighing/dispensing assembly;
- Receiving a signal by the controller from the load cell and the controller determining a weight of the food product accumulating on the one or more dump doors;
- Deactivating the drive motor by the controller upon a target weight being detected;
- Activating the single weighing/dispensing motor by the controller to drive the actuator shaft in the first direction raising the support assembly out of contact with the load cell and opening the one or more dump doors such that accumulated food product is dispensed; and
- Activating the single weighing/dispensing motor by the controller to rotate the actuator shaft in the second direction to close the one or more dump doors.

The various features noted above can be used alone or in various combination to provide for metered dispensing of food products in an accurate manner using a simplified weighing and dispensing arrangement.

BRIEF DESCRIPTION OF THE DRAWINGS

Further advantages and characteristics of the invention will become apparent by the below description of embodiments making reference to the accompanying drawings, in which.

DETAILED DESCRIPTION

Figure 1:
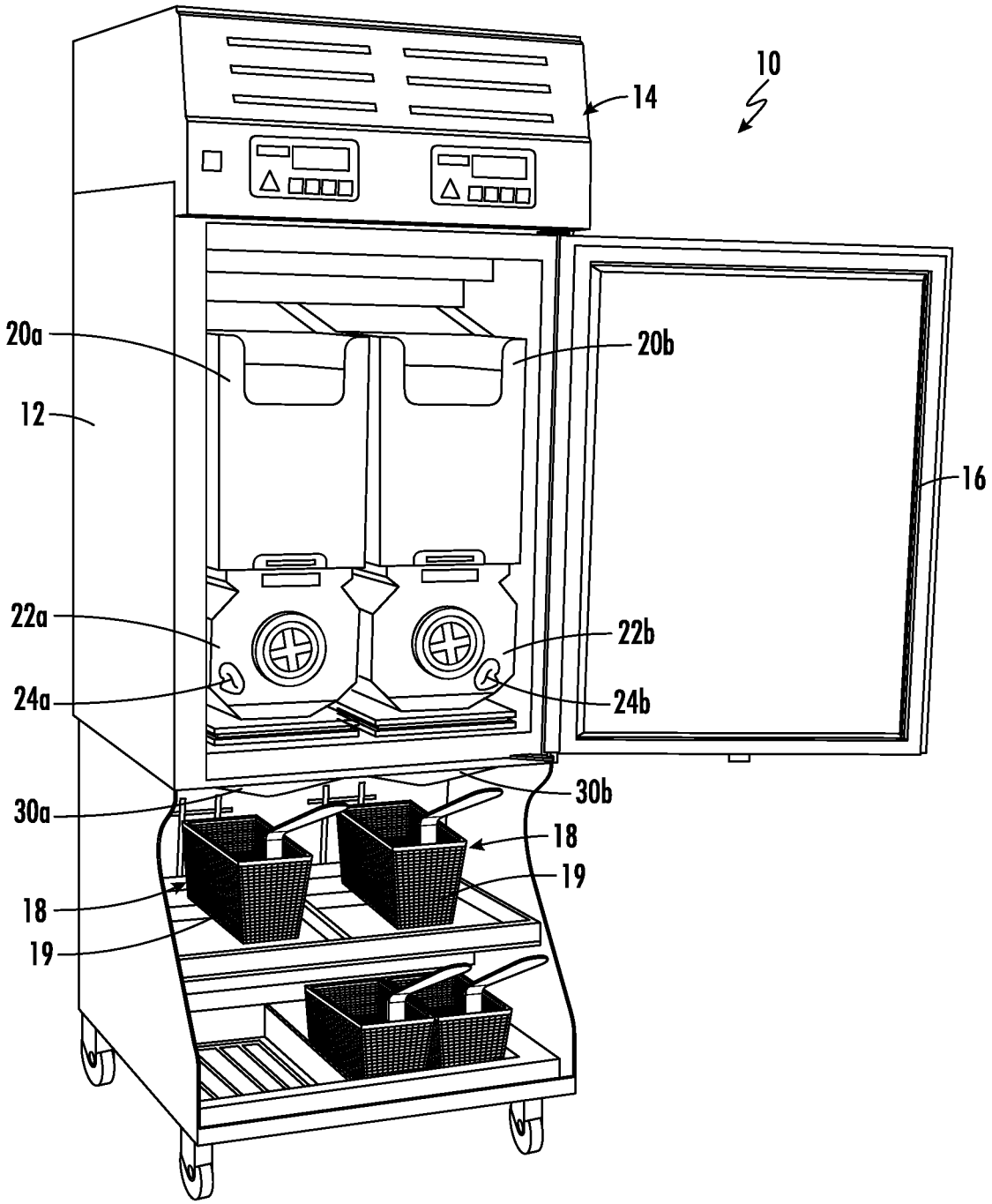
FIG. 1 PRIOR ART
FIG. 1 is a perspective view of a prior art product dispenser of the assignee of the general type referenced herein.

Certain terminology is used in the following description for convenience only and is not limiting. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B or C as well as any combination thereof. The terms approximately or generally mean within +/−10% of a specified value unless otherwise noted, and within +/−25° of a specified angle or direction.

Referring to FIGS. 1-5, a prior art product dispenser 10, in particular a dispenser for frozen food such as french fries or chicken nuggets, is shown. The product dispenser 10 includes a housing 12 with a refrigeration unit 14 located on top of the housing 12 as well as an access door 16 to the refrigerated portion of the product dispenser 10. Product receiving spaces 18 are located beneath the enclosed area and are configured to receive a receptacle, such as a fry basket 19, into which a metered amount of product is to be dispensed.

Figure 2:
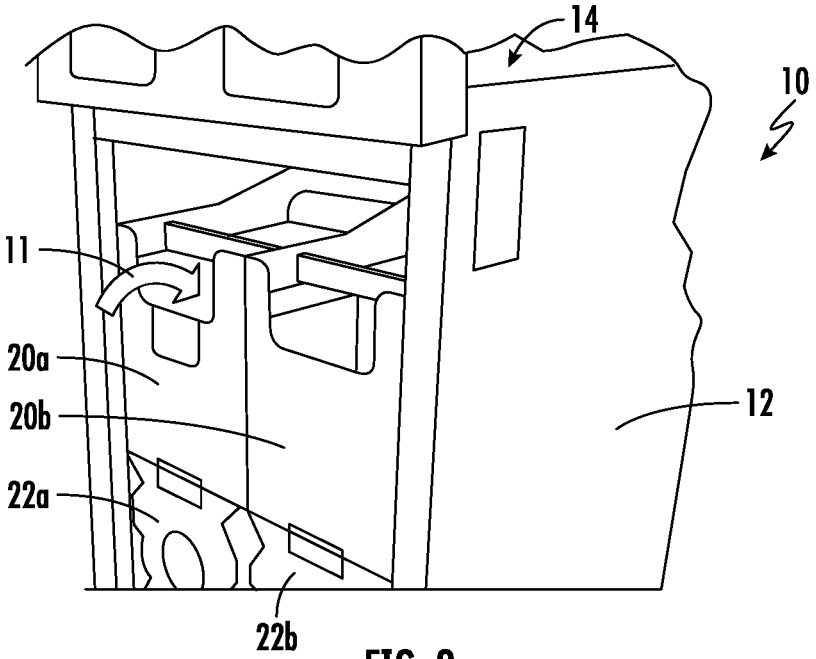
FIG. 2 PRIOR ART
FIG. 2 is a partial perspective view of the prior art product dispenser shown in FIG. 1 illustrating two food storage hoppers with an arrow indicating where food is filed into the first hopper.
Figure 3:
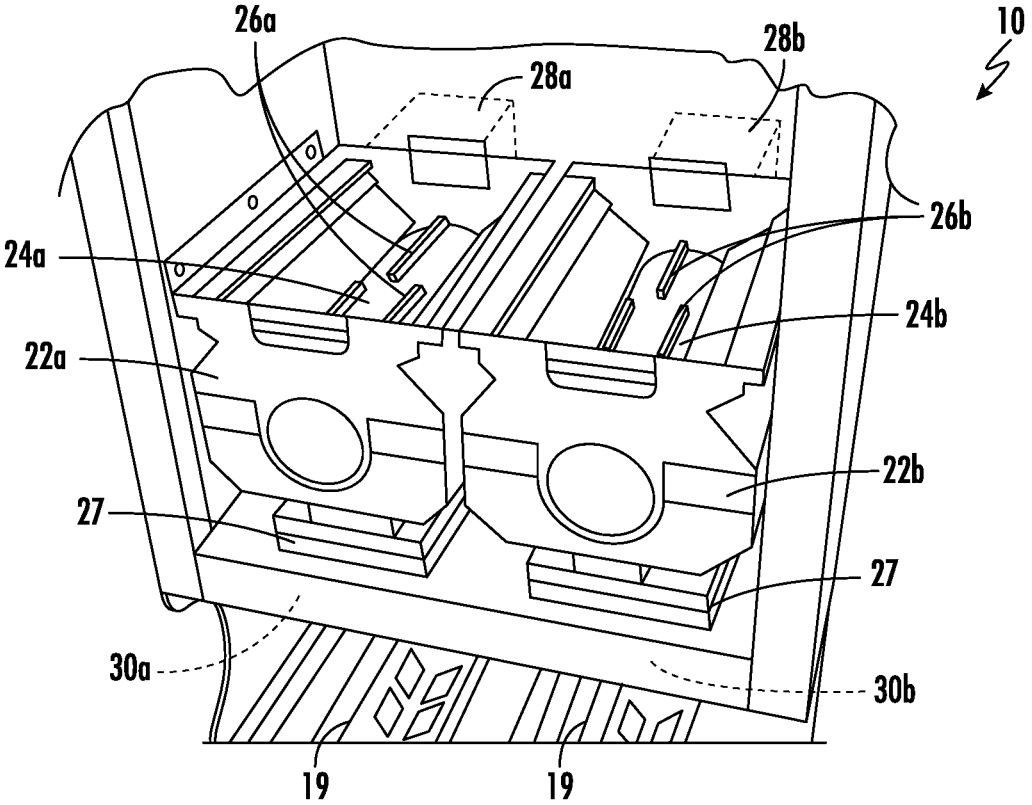
FIG. 3 PRIOR ART
FIG. 3 is a partial perspective view of the prior art product dispenser according to FIG. 1 in which the two food hoppers shown in FIGS. 1 and 2 have been removed in order to provide a view of the rotatable drums with paddles or fins as well as associated drive motors that are individually activatable to rotate the drum associated with a specific hopper in order to remove food product from the open bottom end of the hopper and deliver the food product via an opening at the bottom of the drum housing to a respective weighing/dispensing assembly.
Figure 4:
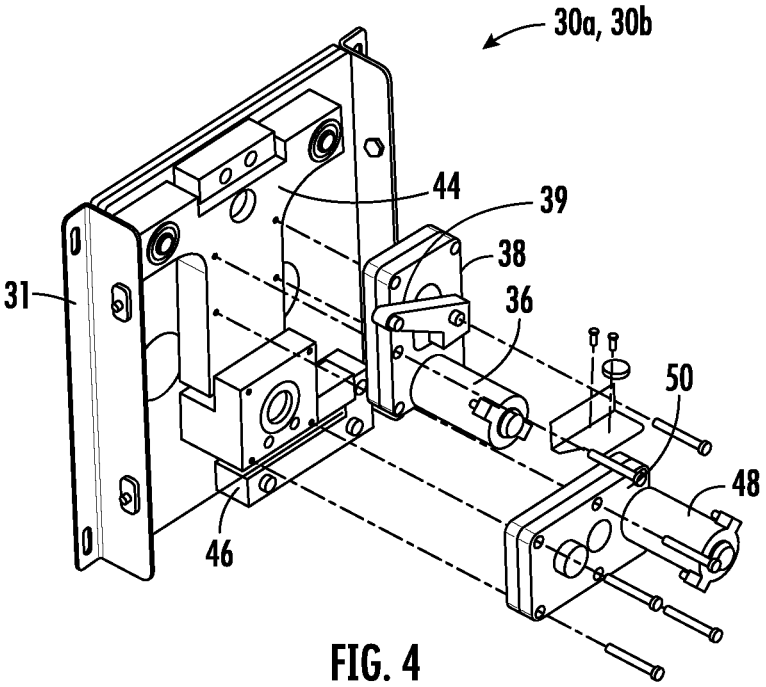
FIG. 4 PRIOR ART
FIG. 4 is an exploded assembly view in perspective showing a portion of one weighing/dispensing assembly in accordance with the prior art product dispenser shown in FIGS. 1-3 showing a dump door motor and gear box assembly used to actuate the dump doors, as well as a support assembly lift motor and gear box assembly used to lift a support assembly into and out of contact with a load cell, with the motor and gearbox assemblies being assembled to a mounting plate and/or a movable support assembly located thereon.
Figure 5:
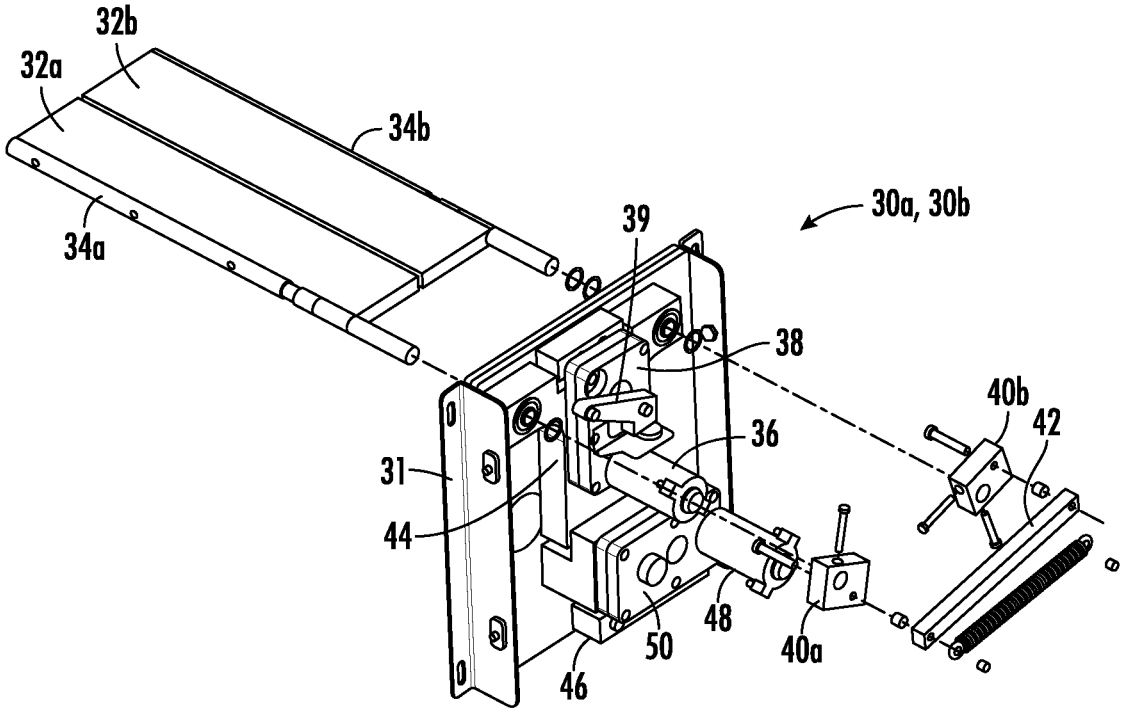
FIG. 5 PRIOR ART
FIG. 5 is a an exploded similar to FIG. 4 in which additional components, including the rotatable shafts with associated dump doors as well as the levers and linkages that are acted upon by the dump door motor and gear box to discharge product from the dump doors are now shown.

Still with reference to FIGS. 1-3, hoppers 20*a*, 20*b* are located within the refrigerated area and are assembled on top of drum housings 22*a*, 22*b*. Frozen food product (indicated by arrow 11 in FIG. 2) can be loaded into the hoppers 20*a*, 20*b* for metered dispensing. As shown in detail in FIG. 3, rotatable drums 24*a*, 24*b* are located within the respective drum housings 22*a*, 22*b*. Flexible paddles or fins (these terms are used interchangeably herein) 26*a*, 26*b* are located on the rotatable drums 24*a*, 24*b*. Drive motors 28*a*, 28*b*, shown schematically, are individually activatable to rotate the respective associated rotatable drum 24*a*, 24*b* in order to move product from the open bottom end of the desired associated hopper 20*a*, 20*b* into the respective drum housings 22*a*, 22*b* so that the product can drop down on to the respective weighing/dispensing assembly 30*a*, 30*b*. These are indicated in FIGS. 1 and 3, and shown in detail in FIGS. 4 and 5. Boots 27 shown in FIG. 3 guide the food product 11 from the open bottom of the drum housings 22*a*, 22*b* to the weighing/dispensing assemblies 30*a*, 30*b*.

The weighing/dispensing assemblies 30*a*, 30*b* each include a mounting plate 31 that is connected to the housing 12. A support assembly 44 is slidably connected to the mounting plate 31 for up and down movement. Rotatable shafts 34*a*, 34*b* are rotatably supported in the support assembly 44 and respective dump doors 32*a*, 32*b* are connected to the respective rotatable shafts 34*a*, 34*b*. A dump motor 36 is mounted on the support assembly 44 and includes a dump motor gear box 38 that is connected to an actuator arm 39 that, upon activation of the dump door motor 36, is rotated into contact with a first dump door drive lever 40*a*, which can be connected via a linkage arm 42 to a second dump door drive lever 40*b* in order to activate and open the dump doors 32*a*, 32*b*. This is done when a specific product weight is accumulated on the dump doors 32*a*, 32*b* based on rotation of an associated one of the rotatable drums 24*a*, 24*b* moving product from the bottom of a respective one of the hoppers 28*a*, 28*b* so it falls through the respective drum housing 22*a*, 22*b*, on to the respective closed dump doors 32*a*, 32*b*.

In order to detect the weight of the product accumulated on the dump doors 32*a*, 32*b*, a load cell 46 is provided and is in contact with the support assembly 44 as the food product is accumulated on the dump doors 32*a*, 32*b* while the rotatable drum 24*a* or 24*b* is rotated by the respective drive motor 28*a* or 28*b*. Once the load cell detects 46 that the desired amount of food product is located on the dump doors 32*a*, 32*b*, rotation of the rotatable drum 24*a* or 24*b* is stopped and the dump door motor 36 is activated in order to open the dump doors 32*a*, 32*b*. In order to move the support assembly 44 out of contact with the load cell 46, a support assembly lift motor 48 is provided and is connected to a support assembly lift gear box 50. The support assembly lift motor 48 is activated in order to raise the support assembly 44 out of contact with the load cell 46 when the dispensing cycle is completed so that the load cell 46 is not loaded until a next dispensing cycle is initiated and the support assembly lift motor is activated to move the support assembly 44 into contact with the load cell 46.

This weighing/dispensing assembly 30*a*, 30*b* is complex and includes the dump door motor 36 and the dump door gear box 38 as well as the support assembly lift motor 48 and the support assembly lift gear box 50, all of which increase costs and complexity as well as require additional maintenance.

Referring to FIGS. 6-10, a product dispenser 110 in accordance with the present disclosure having the improved features discussed herein is described in detail. The product dispenser 110 is similar to the product dispenser 10 and the housing 12, refrigeration unit 14 as well as the access door 16 and fry basket receiving spaces 18 are as described above. Additionally, the hoppers 20*a*, 20*b* as well as the drum housings 22*a*, 22*b* and rotatable drums 24*a*, 24*b* are provided as described above in connection with the product dispenser 10. Drive motors 28*a*, 28*b* as described above for driving the rotatable drums 24*a*, 24*b* are also provided and are used to drive the respective rotatable drums 24*a*, 24*b* to engage with and move food product from the open bottom of a respective hopper 20*a* or 20*b* to a position in the drum housing 22*a*, 22*b* where the food product can then fall through the open bottom of the drum housing 22*a*, 22*b*. While the product dispenser is described with a two hopper arrangement as shown in FIG. 1, it could also be a single hopper arrangement or include more than two hoppers.

Figure 9:
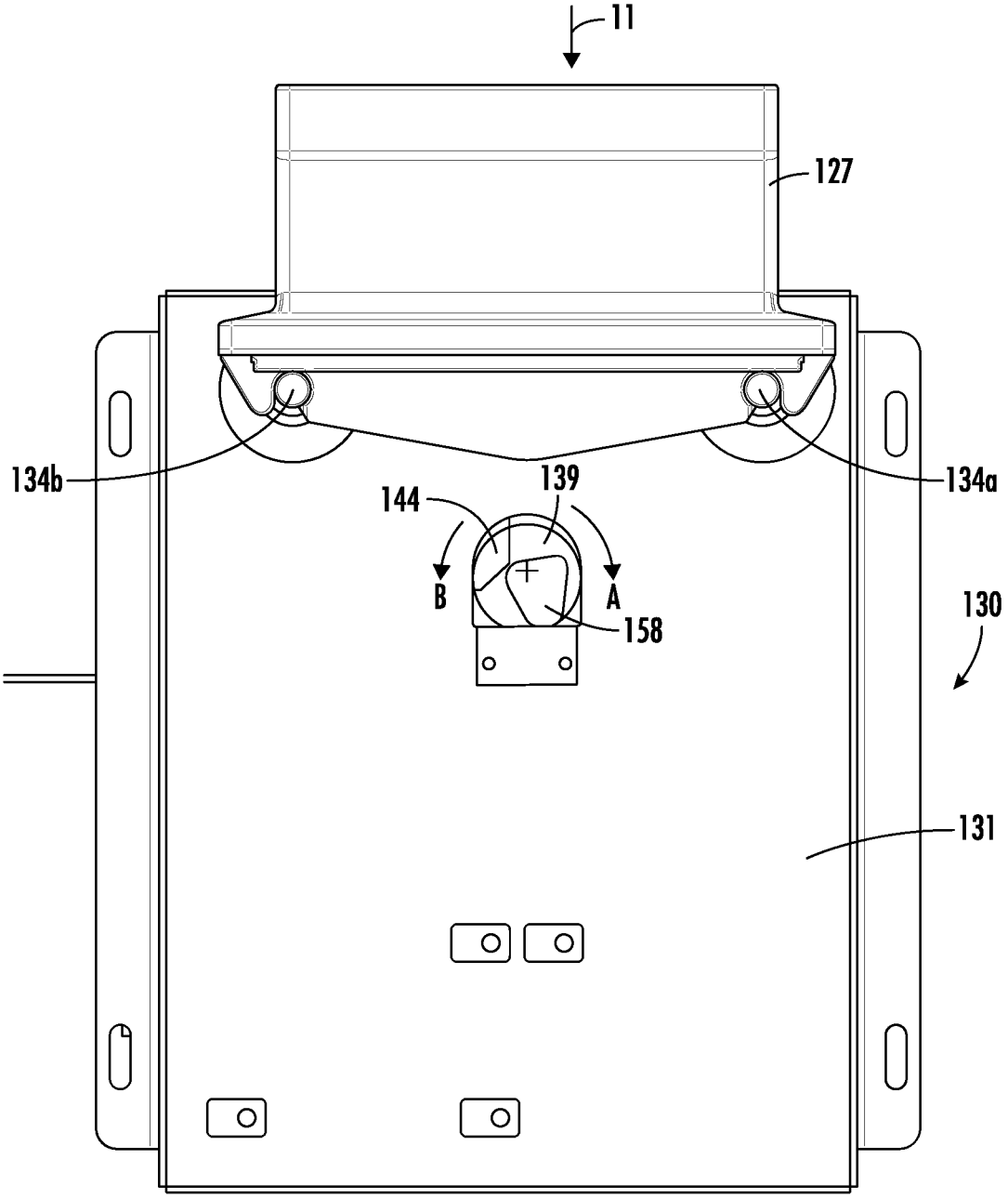
FIG. 9 is a front elevational view of the weighing/dispensing assembly shown in FIGS. 6-8 in which the weighing/dispensing motor has rotated the lifting cam in the first direction to raise the support assembly out of contact with the load cell.
Figure 10:
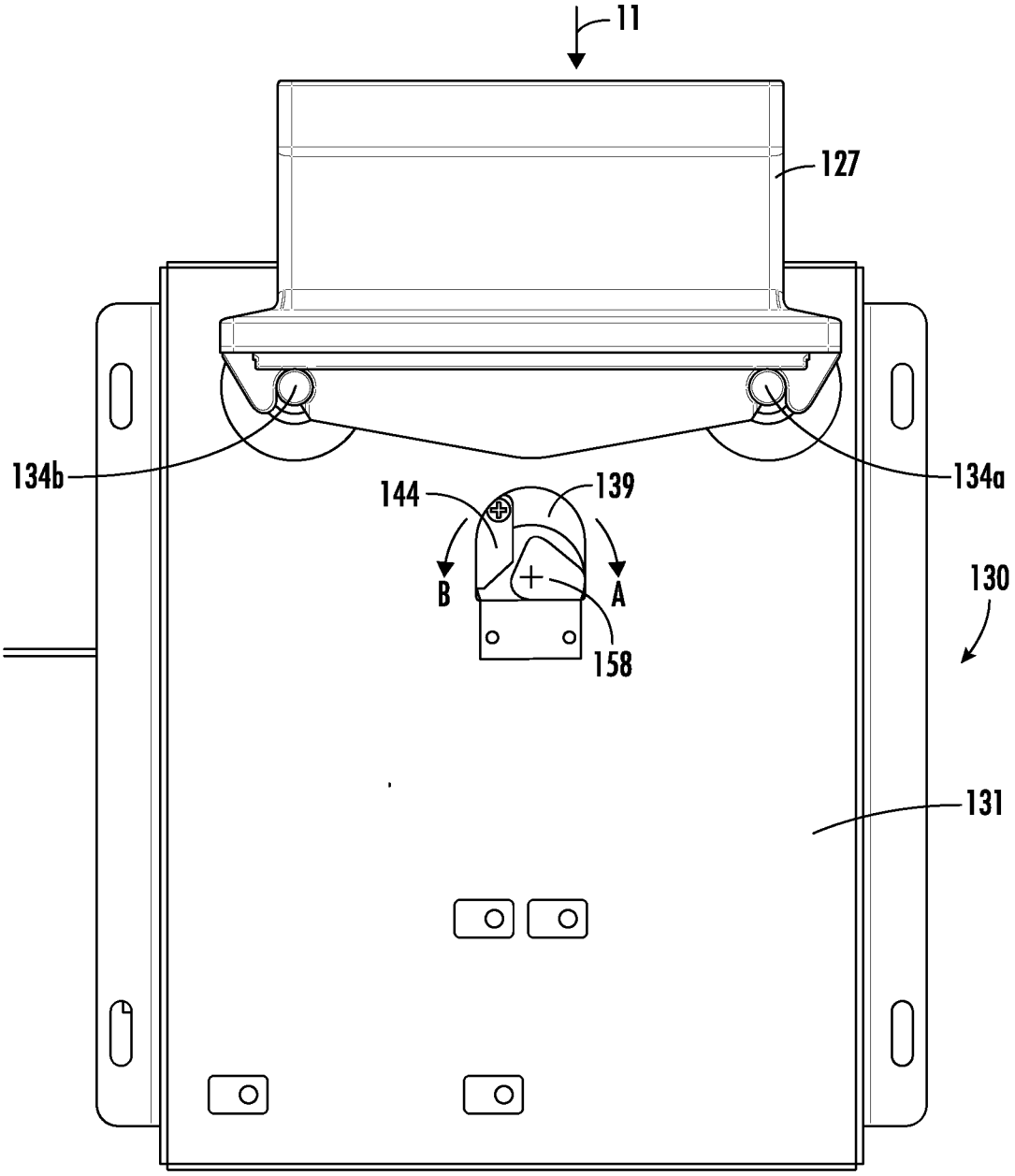
FIG. 10 is a view similar to FIG. 9 in which the lifting cam is rotated in a second direction into a position out of contact with the support assembly such that the weight of the support assembly is transferred to the load cell.

In accordance with the present disclosure, the weighing/dispensing assembly 130 is provided instead of each of each of the prior weighing/dispensing assemblies 30*a*, 30*b*. The weighing/dispensing assembly 130 that is used for each respective hopper/rotating drum in the dispenser 10 is shown in detail in FIGS. 6-10 and includes only a single weighing/dispensing motor 136. Here, the weighing/dispensing assembly 130 preferably includes a mounting plate 131 on which a support assembly 144 is mounted for slidable up and down movement as described further below. The mounting plate 131 can be connected to or supported on the housing 12. A weighing/dispensing assembly 130 further includes a load cell 146 and includes or is connected to one or more dump doors, in the present case two dump doors, 132*a*, 132*b*. Here, food product that is dispensed from the hopper via the rotatable drum is accumulated and weighed by the load cell 146. The dump door(s) 132*a*, 132*b* are connected to the support assembly 144, preferably by being mounted on respective rotatable shafts 134*a*, 134*b* that are rotatably supported in bearings 135 located in the support assembly 144. FIGS. 8-10 show the boot 127 that leads from the open bottom of the drum housings 24*a*, 24*b* to guide food product 11 being dispensed to the dump doors.

Figure 7:
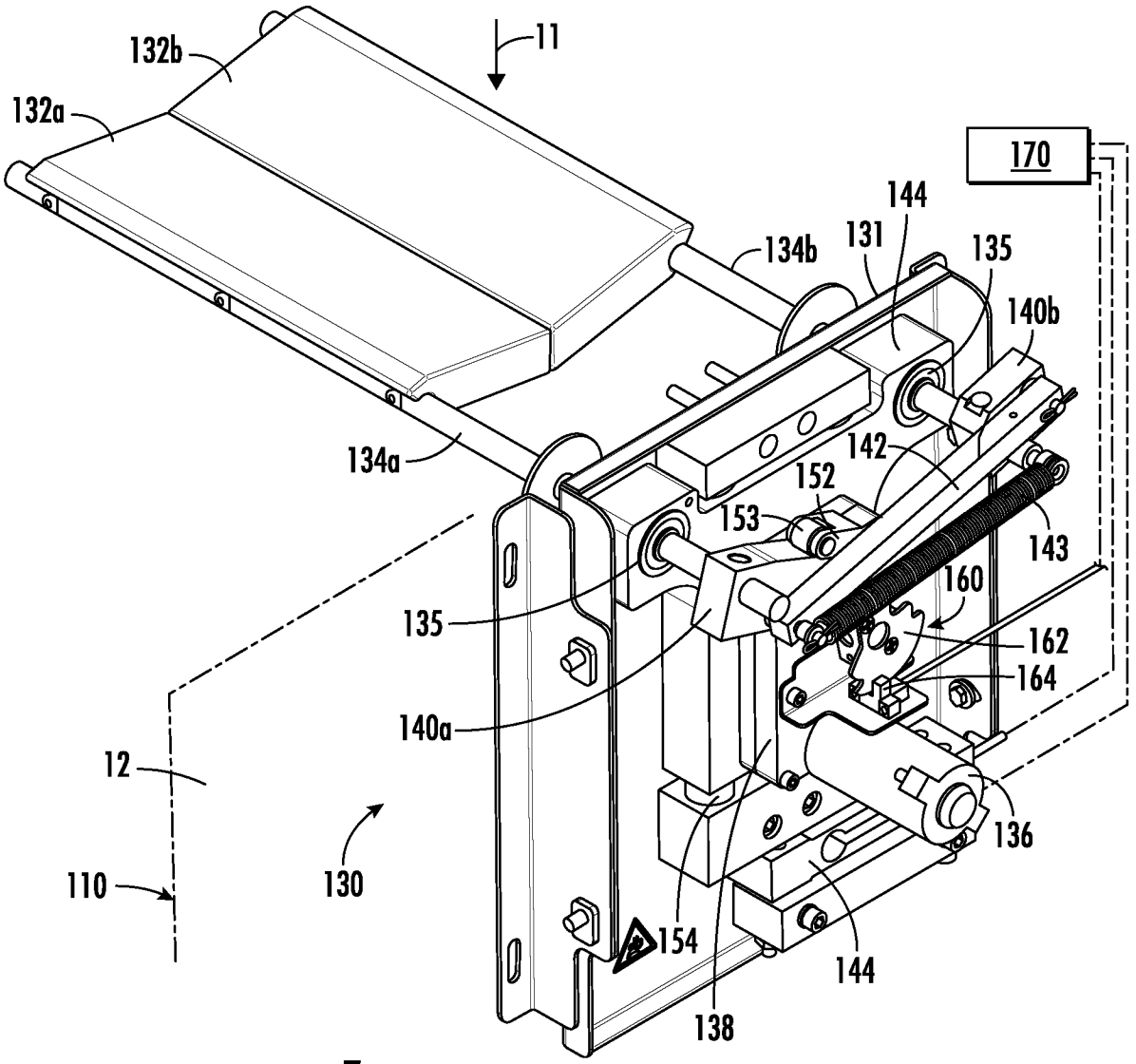
FIG. 7 is a perspective view of the weighing/dispensing assembly according to the present disclosure as shown in FIG. 6, shown from the opposite side in which the single weighing/dispensing motor and associated gear box along with the levers that actuate the dump doors are shown in detail.
Figure 8:
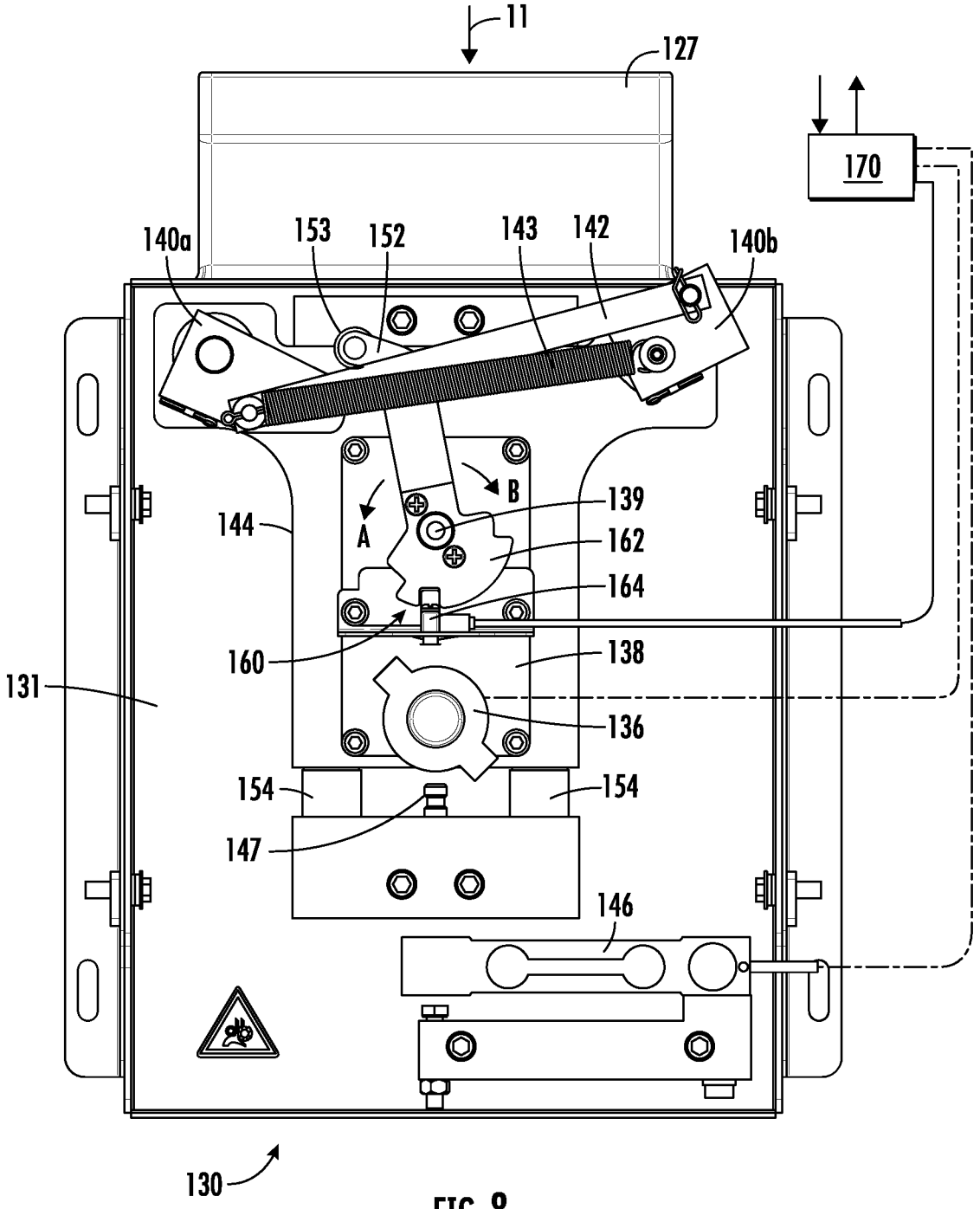
FIG. 8 is a rear elevational view of the weighing/dispensing assembly shown in FIG. 7. Here, the actuating arm is shown in a neutral position.

As shown in detail in FIGS. 7 and 8, the single weighing/dispensing motor 136 is connected to a weighing/dispensing gear box 138 from which an actuator shaft 139 extends. When the actuator shaft 139 is driven in a first direction A (shown in FIG. 8), the support arrangement 144 is raised out of contact with the load cell 146 and the one or more dump doors 132*a*, 132*b* are opened such that the accumulated food product is dispensed. Upon rotation of the actuator shaft 139 in a second, opposite direction B (shown in FIG. 8), the one or more dump doors 132*a*, 132*b* are closed. Upon further rotation, the support assembly 144 moves into contact with the load cell 146 so the next dispensing/weighing cycle can be carried out when a next batch of food product is dispensed from a respective one of the hoppers 20*a*, 20*b*.

Figure 6:
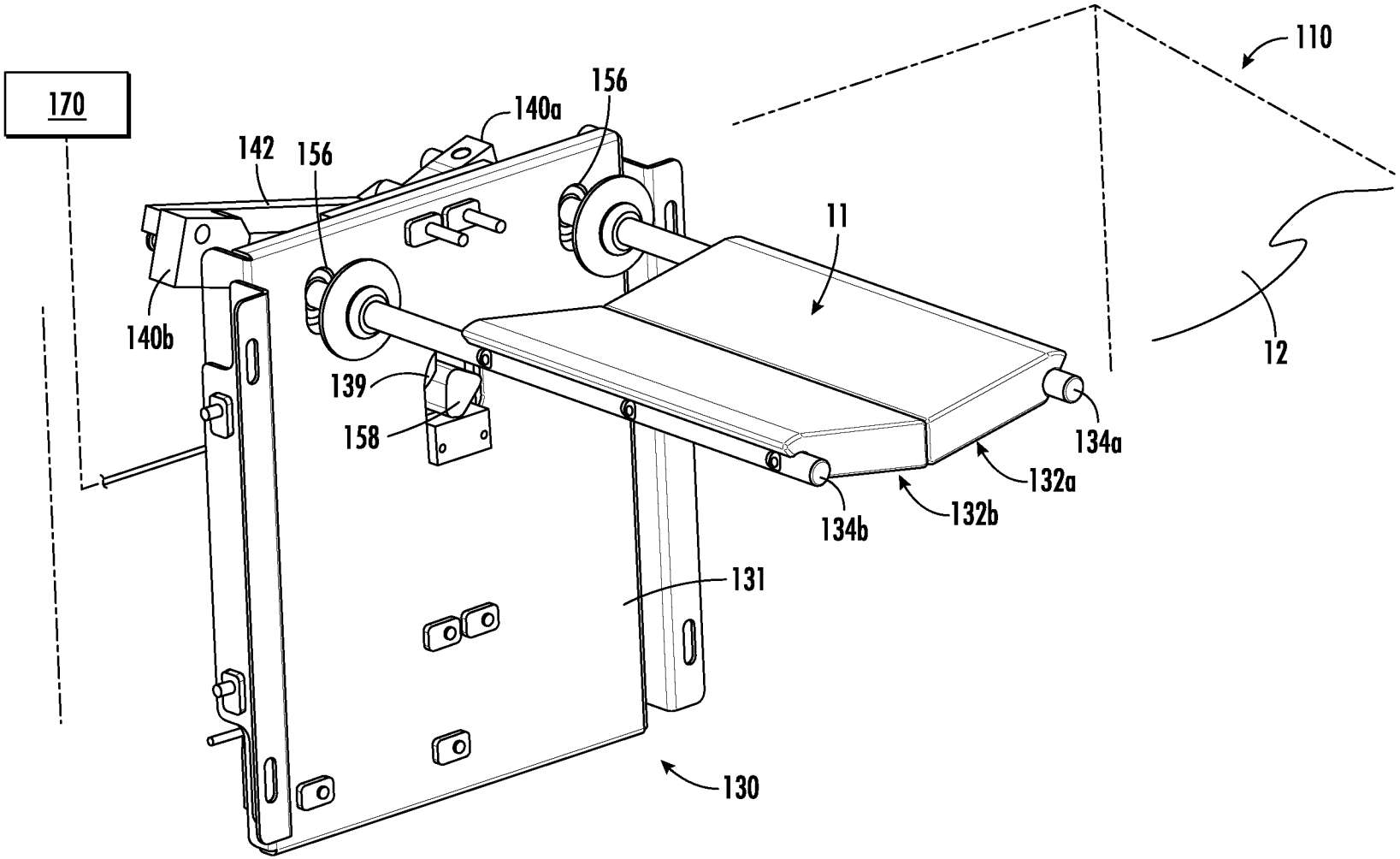
FIG. 6 is a perspective view showing a weighing/dispensing assembly for use in a product dispenser in accordance with the present disclosure.

As shown schematically in FIGS. 6-8, a controller 170 is provided and is configured to actuate a drive motor 28*a* or 28*b* at a start of a dispensing cycle and is further considered to receive a signal from the load cell 146 in order to determine a weight of the food product accumulating on the dump doors 132*a*, 132*b*. The controller 170 is further configured to de-activate the drive motor 28*a* or 28*b* upon a target weight being detected and to activate the single weighing/dispensing motor 136 to drive the actuator shaft 139 via the gearbox 138 in the first direction to raise the support arrangement 144 out of contact with the load cell 146. Preferably, a lifting cam 158, shown in detail in FIGS. 9 and 10 is connected to the actuator shaft 139 and the lifting cam 158 is configured to raise the support assembly 144 as the single weighing/dispensing motor 136 drives the actuator shaft 139 in the first direction. This removes the combined weight of the support assembly 144, the rotatable support shafts 134*a*, 134*b*, the dump doors 132*a*, 132*b*, and the food product 11 that is accumulated on the dump doors 132*a*, 132*b* from the load cell 146 prior to the dump doors 132*a*, 132*b* opening to discharge the product accumulated thereon. In FIG. 9, the lifting cam 158 is shown in the position lifting the support assembly 144 out of contact with the load cell 146. In FIG. 10, the lifting cam 158 is shown in the disengaged position such that the support assembly 144 is in contact with the load cell 146 so that the weight of the product being dispensed can be determined.

The controller 170 is further configured to activate the single weighing/dispensing motor 136 to rotate the actuator shaft 139 in the second direction to close the one or more dump doors 132*a*, 132*b* once the product has been dispensed for example into the fry basket 19 or other receptacle, for example as shown in FIG. 1. The controller 170 is further configured to activate the single weighing/dispensing motor 136 to rotate the actuator shaft 139 in the second direction to move the support assembly 144 back into contact with the load cell 146 upon a new dispensing cycle being initiated.

As shown in detail in FIGS. 7 and 8, the weighing/dispensing assembly 130 further includes an actuating arm 152 connected to the actuator shaft 139, and the one or more dump doors 132*a*, 132*b* are connected to the respective rotatable shafts 134*a*, 134*b* that are supported by the support assembly 144. The actuating arm 152 contacts a dump door lever 140*a* connected to one of the rotatable shafts 134*a* or 134*b* in order to open the dump door(s) 132*a*, 132*b* as the single weighing/dispensing motor 136 drives the actuator shaft 139 in the first direction. In a preferred embodiment, a roller 153 is provided at an end of the actuating arm 152 and contacts a surface of the dump door drive lever 140*a*.

In the case of two dump doors 132*a*, 132*b*, a second dump door drive lever 140*b* is connected to the second rotatable shaft 134*b* for the second dump door 132*b*. A linkage arm 142 extends between the dump door drive levers 140*a*, 140*b* such that upon the first dump door lever 140*a* being acted upon by the actuating arm 152, the linkage arm 142 also transfers the movement to the second dump door drive lever 140*b* such that the first and second dump doors 132*a*, 132*b* are opened at the same time. A return spring 143 assists in closing the dump doors 132*a*, 132*b*.

While the preferred embodiment of the weighing/dispensing assembly 130 includes two dump doors 132*a*, 132*b*, it is possible that only a single dump door 132*a* could be utilized, which would eliminate the need for the linkage arm 142 that extends to the second dump door drive lever 140*b*.

Still with reference to FIGS. 7 and 8, the support assembly 144 is preferably slidably mounted on guides on 154 so that it is constrained to move only up and down. The support assembly 144 can be lifted up by the lifting cam 158 so that it is out of contact with the load cell 146 or, if the lifting cam 158 is disengaged from the support assembly 144, the weight of the product being dispensed upon the dump doors 132*a*, 132*b* (along with the weight of the support assembly 144 and connected components) causes the support assembly 144 to move downwardly against the load cell 146. In a preferred embodiment, a weight transfer pin 147 is located between the load cell 146 and the support assembly 144.

As shown in FIG. 6, elongated openings 156 are provided in the support plate 131 through which the one or more rotatable support shafts 134*a*, 134*b* extend. These elongated openings 156 allow enough space for upward and downward travel for rotatable support shafts 134*a*, 134*b* as the support assembly 144 is moved up and down as part of the dispensing and weighing cycle.

The lifting cam 158 is shown in the upper, raised position of the support assembly 154 in FIG. 9, and upon the single weighing/dispensing motor 136 driving the actuator shaft 139 in the second direction, the lifting cam 158 rotates to the position shown in FIG. 10 so that the support assembly 144 is in contact with the load cell 146. This is only done at the start of a dispensing cycle so that the load cell 146 is not under load when the product dispenser 110 is not in use. As shown in FIG. 10, the lifting cam 158 comes out of contact with the support assembly 144 as it reaches a weighing position in contact, via the weight transfer pin 147, with the load cell 146.

Referring again to FIGS. 7 and 8, a position indicator 160 is preferably connected to the actuator shaft 139 and a sensor, such as a break-beam sensor 164, detects a position of the position indicator 160 and signals the controller 170. In a preferred embodiment, the position indicator 160 is a flag 162 that includes two sections which interrupt the break-beam sensor, depending upon a position of the actuator shaft 139. In FIG. 8, the position indicator is shown in a ready position. Here, the support assembly 144 is out of contact with the load cell 146 prior to a dispensing operation being initiated. Once the dispensing operation is initiated, the actuator shaft 139 rotates in the second direction so that the lifting cam 158 is moved into the position shown in FIG. 10 and the support assembly 144 is in contact with the load cell 146, for example via the weight transfer pin 147, so that food product that is dispensed can be weighed. A second portion of the flag 162 detects when the actuator shaft 139 rotates in the first direction to a position in which the lifting cam 158 has moved the support assembly 144 out of contact with the load cell 146 and the dump doors 132*a*, 132*b* have been opened via the actuating arm 152 contacting the dump door drive lever 140*a*.

The product dispenser 110 is preferably used for dispensing frozen food product, such as French fries or chicken nuggets into a receptacle, such as a fry basket 19, that is arranged below the dump doors. A sensor, such as a contact switch, proximity sensor, or break beam sensor, is positioned in each said receiving space 18 in order to detect when a fry basket 19 or other receptacle is placed into a or the respective receiving space so that the dispensing cycle can be initiated by the controller 170.

In a preferred arrangement, two of the hoppers 20*a*, 20*b*, rotatable drums 24*a*, 24*b*, and weighing/dispensing assemblies 130 are provided in the dispenser 110. However, the dispenser 110 could include only a single hopper 20*a*, rotatable drum 24*a*, and weighing assembly 130, if desired. Additionally, more than two of the dispensing arrangements including the hoppers, rotating drums, and weighing/dispensing assemblies could also be provided.

In one preferred arrangement, the dispensing cycle can include:

Activating the single weighing/dispensing motor 136 by the controller 170 to rotate the actuator shaft 139 in the second direction to move the support assembly 144 into contact with the load cell 146 to begin a dispensing cycle, which can be triggered by placement of the fry basket below the dispenser 110 to activate a dispensing cycle by the fry basket pressing a switch or otherwise being detected, which signals the controller 170 to begin a dispensing cycle;

Actuating the drive motor 28*a* or 28*b* via the controller 170 to rotate the rotatable drum 24*a* or 24*b*; receiving a signal by the controller 170 from the load cell 146 and the controller 170 determining a weight of the food product accumulating on the dump doors 132*a*, 132*b;*

Deactivating the drive motor 28*a* or 28*b* by the controller 170 upon a target weight being detected;

Activating the single weighing/dispensing motor 136 by the controller 170 to drive the actuator shaft 139, via the weighing/dispensing gear box 138, in the first direction to raise the support assembly 144 out of contact with the load cell 146 and opening the one or more dump doors 132*a*, 132*b* such that accumulated food product is dispensed; and Activating the single weighing/dispensing motor 136 by the controller 170 to rotate the actuator shaft 139 in the second direction to close the one or more dump doors 132*a*, 132*b*. Preferably, the single weighing/dispensing motor 136 is stopped via the controller 170 when it reaches the neutral position, shown in FIG. 8, so that the support assembly 144 is not in contact with the load cell 146 until a next dispensing cycle is initiated.

It will be appreciated that the foregoing is presented by way of illustration only and not by way of any limitation. It is contemplated that various alternatives and modifications may be made to the described embodiments without departing from the spirit and scope of the invention. Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

List of Reference Numbers

10 Prior art product dispenser
11 food product
12 housing
14 refrigeration unit
16 access door
18 fry basket receiving spaces
19 fry basket
20*a,b* hopper(s)
22*a, b* drum housing(s)
24*a,b* rotatable drum(s)
26*a, b* paddles (or fins)
27 boot
28*a, b* drive motor(s)
30*a, b* weighing/dispensing assembly
31 mounting plate
32*a, b* dump door(s)
34*a, b* rotatable shaft(s)
36 dump door motor
38 dump door gearbox
39 actuator arm
40*a, b* dump door drive lever(s)
42 linkage arm
44 support assembly
46 load cell
48 support assembly lift motor
50 support assembly lift gearbox
110 Product dispenser
127 boot
130 weighing/dispensing assembly
131 mounting plate
132*a, b* dump door(s)
134*a, b* rotatable shaft(s)
135 bearings
136 weighing/dispensing motor
138 weighing/dispensing gearbox
139 actuator shaft
140*a, b* dump door drive lever(s)
142 linkage arm
143 return spring
144 support assembly
146 load cell
147 weight transfer pin
152 actuating arm
153 roller
154 guides for support assembly
156 elongated openings in mounting plate
158 lifting cam
160 position indicator
162 Flag
164 break-beam sensor
170 controller

The invention claimed is:

1. A product dispenser, comprising:

a storage hopper;

a rotatable drum having paddles on a periphery thereof located at a bottom of the storage hopper, and a drive motor connected to the rotatable drum;

a weighing/dispensing assembly located beneath the rotatable drum, the weighing/dispensing assembly includes a load cell and further includes or is connected to one or more dump doors on which product to be dispensed is adapted to accumulate, the one or more dump doors are connected to a support assembly that is movable into and out of contact with the load cell, and a single weighing/dispensing motor that drives a gearbox that includes an actuator shaft that upon rotation in a first direction, raises the support assembly out of contact with the load cell and opens the one or more dump doors such that accumulated product is dispensed, and upon rotation in a second direction, closes the one or more dump doors and upon further rotation moves the support assembly into contact with the load cell;

a controller configured to actuate the drive motor to rotate the rotatable drum at a start of a dispensing cycle, to receive a signal from the load cell and determine a weight of the product accumulating on the one or more dump doors and deactivate the drive motor upon a target weight being detected, and to activate the single weighing/dispensing motor to drive the actuator shaft in the first direction to raise the support assembly out of contact with the load cell and open the one or more dump doors such that accumulated product is dispensed, and to then rotate the actuator shaft in the second direction to close the one or more dump doors, and the controller is further configured to rotate the actuator shaft in the second direction to move the support assembly back into contact with the load cell at a start of a next dispensing cycle.

2. The product dispenser of claim 1, further comprising an actuating arm connected to the actuator shaft, and wherein the one or more dump doors are connected to one or more rotatable support shafts that are supported by the support assembly, and the actuating arm contacts a lever connected to at least one of the one or more rotatable support shafts to open the one or more dump doors as the single weighing/dispensing motor drives the actuator shaft in the first direction.

3. The product dispenser of claim 2, wherein the one or more dump doors include first and second ones of the dump doors that are connected to respective first and second ones of the one or more rotatable support shafts, and a linkage arm extends between the lever connected to the first support rotatable shaft and a second lever connected to the second support rotatable shaft, such that as the actuating arm contacts the lever connected to the first rotatable support shaft to open the first dump door, the linkage arm acts on the second lever to open the second dump door.

4. The product dispenser of claim 2, wherein the support assembly is slidably mounted on guides affixed to a mounting plate, and the mounting plate includes elongated openings through which the one or more rotatable support shafts extend.

5. The product dispenser of claim 1, further comprising a lifting cam connected to the actuator shaft, the lifting cam is configured to raise the support assembly as the single weighing/dispensing motor drives the actuator shaft in the first direction.

6. The product dispenser of claim 5, wherein the lifting cam is configured to lower the support assembly as the single weighing/dispensing motor drives the actuator shaft in the first direction.

7. The product dispenser of claim 6, wherein the lifting cam is configured to come out of contact with the support assembly as the support assembly reaches a weighing position in contact with the load cell.

8. The product dispenser of claim 1, further comprising a position indicator connected to the actuator shaft and a sensor that detects a position of the position indicator and signals the controller.

9. The product dispenser of claim 8, wherein the position sensor is a break-beam sensor.

10. The product dispenser of claim 1, further comprising a refrigerated housing that surrounds the hopper and the rotatable drum.

* * * * *